United States Patent [19]

Grosjean

[11] 3,991,798

[45] Nov. 16, 1976

[54] DISPOSABLE DEVICE FOR SHARPENING LEADS OR THE LIKE

[76] Inventor: Robert M. Grosjean, 4625 Merry Lane, Toledo, Ohio 43615

[22] Filed: Sept. 19, 1975

[21] Appl. No.: 615,052

[52] U.S. Cl. ..... 144/28.1; 144/28.9; 145/3.32; 145/3.8

[51] Int. Cl.[2] ..... B43L 23/00

[58] Field of Search ..... 144/28, 28.11, 28.2, 144/28.6, 28.9, 28.1; 145/3.31, 3.32, 3.61, 3.8, 3.9

[56] References Cited

UNITED STATES PATENTS 3,698,456 10/1972 Cho ..... 144/28.11

*Primary Examiner*—Othell M. Simpson
*Assistant Examiner*—W. D. Bray
*Attorney, Agent, or Firm*—Allen D. Gutchess, Jr.

[57] ABSTRACT

A device is provided for sharpening leads of pencils or the like. The sharpening device is disposable and is designed to be thrown away when filled, without the necessity for cleaning out the device which inherently results in a dirty mess and in a waste of time. The sharpening device employs a minimum number of parts so as to achieve low cost and dependability in operation. A main top unit and a main lower unit are rotatably connected together without any additional elements such as nuts or the like being required. The sharpener also includes a gasket which retains the powdered graphite from the lead in the lower unit and also wipes the lead being sharpened. The outer wall of the lower unit has a truncated conical abrasive surface to effect the sharpening, with this wall being somewhat flexible to avoid breakage of the lead being sharpened. The sharpener can be mounted in place on a drafting table or the like by an adhesive disc or by a separable mounting block which is reusable.

16 Claims, 4 Drawing Figures

DISPOSABLE DEVICE FOR SHARPENING LEADS OR THE LIKE

This invention relates to a sharpening device for leads of pencils or the like.

Various devices for sharpening points of pencil leads, particularly of the type used by draftsmen, are well known in the art. Heretofore, the sharpening devices were usually expensive and permanent so that they required cleaning from time-to-time. This inherently has been a dirty operation and also time-consuming. Such devices also had open tops from which the powdered graphite could be spilled and the sharpened leads also required cleaning after the sharpening was complete to remove powdered graphite clinging thereto.

The present invention provides an expendable sharpening device for leads which is simply thrown away when it becomes full of the graphite powder or when the abrasive surface becomes worn. All cleaning is eliminated and a resilient gasket in the device prevents spilling of the graphite powder and also wipes the lead as it is being sharpened. An expendable sharpening device of this general nature is disclosed in my U.S. Pat. No. 3,667,516, issued on June 6, 1972, with the advantages of the expendability being discussed more fully therein.

The new sharpening device according to the instant invention has a number of features over earlier devices. The new device includes a minimum number of parts to reduce manufacturing costs and to provide reliability in operation. The new sharpening device also has a unique rotatable connection between the main upper and lower units of the device. A gasket located between the upper and lower units is mounted on the lower one and held against rotation by projections extending from the lower unit while the upper unit retains the gasket in position through an inner flange and an outer lip or ridge. The gasket is preferably of a closed cell plastic foam material with an upper plastic surface which prevents the gasket from being punctured by the lead point and also is more effective to retain the powdered graphite in the lower unit.

The abrasive surface for the sharpening device is on an outer wall of the lower unit and is shaped in a truncated conical configuration. This portion of the outer wall is somewhat flexible to avoid breaking the lead which is inserted through a guide passage in the top unit and into contact with the abrasive surface. The new sharpening device can be mounted on a drafting table by means of an adhesive disc on the bottom or it can be mounted in a block which is affixed to the table by an adhesive lower surface.

It is, therefore, a principal object of the invention to provide an improved disposable sharpening device for leads or the like having the advantages outlined above.

Many other objects and advantages of the invention will be apparent from the following detailed description of preferred embodiments thereof, reference being made to the accompanying drawings, in which.

Figure 1:
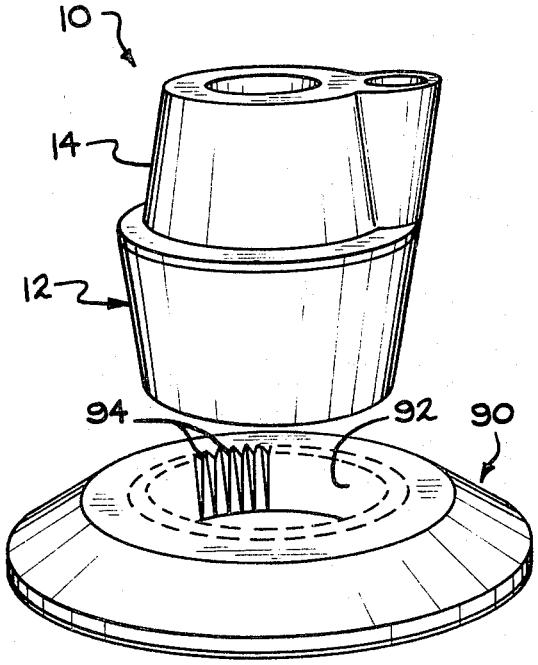
FIG. 1 is a somewhat schematic view in perspective of an overall sharpening device embodying the invention.
Figure 3:
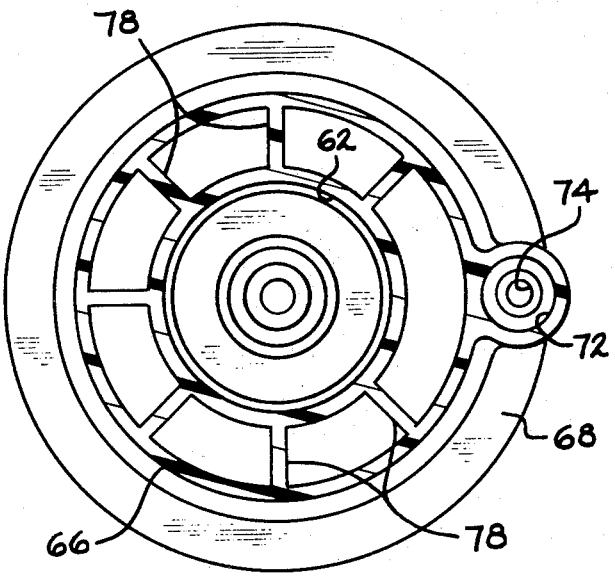
FIG. 3 is a view in horizontal cross section taken along the line 3—3 of FIG. 2.
Figure 2:
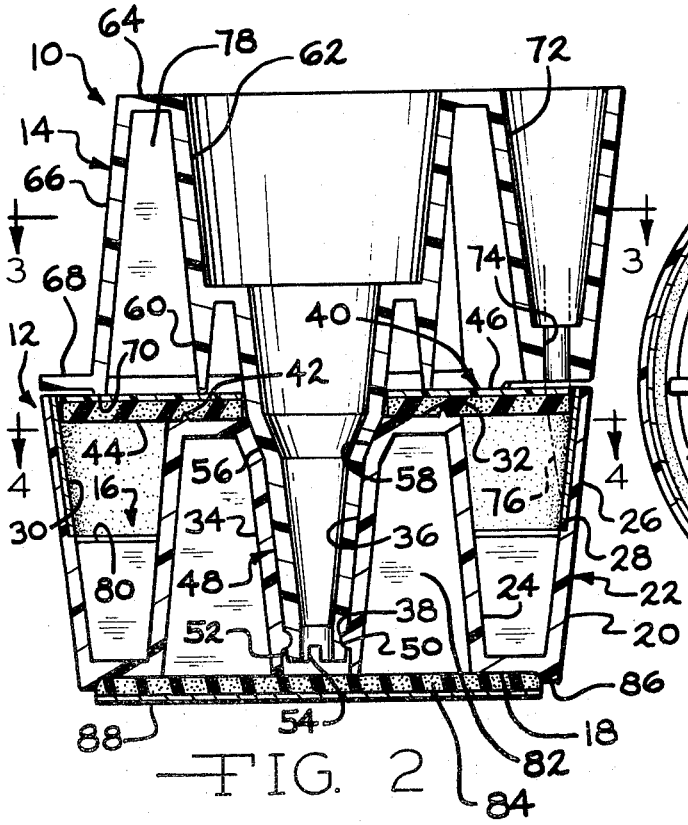
FIG. 2 is an enlarged view in vertical cross section taken centrally through the sharpening device.
Figure 4:
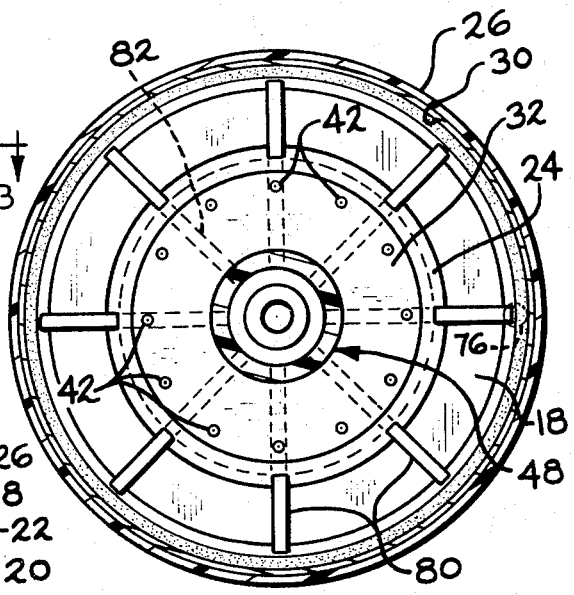
FIG. 4 is a view in horizontal cross section taken along the line 4—4 of FIG. 2.

Referring to FIGS. 1 and 2, a sharpening device for sharpening or pointing leads of pencils or the like is indicated at 10 and includes a one-piece lower base unit or container 12 and a one-piece upper unit or guide 14. The upper and lower units 12 and 14 preferably are made of an inexpensive plastic material, such as polypropylene or medium-impact styrene, by way of example. The lower unit 12 forms an annular lower cavity 16 to receive powdered graphite from the leads being sharpened. The cavity is formed by an annular bottom wall 18, a lower portion 20 of an outer truncated conical wall 22, and by an inner truncated conical wall 24. An upper portion 26 of the outer wall 22 is thinner than the lower portion 20, with an offset or shoulder 28 formed therebetween. The thinner upper wall portion 26 provides flexibility or yieldability for the lower unit 12 so that a lead pushed downwardly can force out the upper portion 26 of the outer wall 22 to some extent and thereby avoid breakage of the lead. An abrasive strip which can be provided in one piece as a truncated conical member 30 is affixed to the inner surface of the upper wall portion 26, as by adhesive at two diametrically-opposite portions of the abrasive strip and the wall. The shoulder 28 helps to position the abrasive member 30 to expedite manufacturing of the sharpener.

The lower unit 12 further includes an annular supporting wall or web 32 integral with the upper edge of the inner truncated conical wall 24 with a central wall or sleeve 34 extending downwardly from the inner edge of the annular wall 32. The wall 34 forms a tapered central passage 36 with an annular inwardly-extending ridge 38 near the bottom of the passage.

A gasket or annular sheet member 40 is supported on the web 32 of the lower unit 12 and is held from rotating thereon by a plurality of projections 42 extending upwardly from the web. In a preferred form, the gasket 40 includes a main layer or portion 44 made of a closed-cell foam material with an upper plastic layer 46 thereon. This can be a separate sheet affixed to the main portion 44 or can be a plastic coating thereon, being a vinyl material, for example. This construction of the gasket prevents a pencil lead from penetrating the main portion 44 of the gasket by virtue of the plastic layer 46 and also reduces the chance of the powdered graphite in the lower cavity 16 escaping. The gasket 40 extends substantially completely to the upper portion 26 of the outer wall 22 and is yieldably moved downwardly as a lead is inserted between the edge of the gasket and the outer wall portion 26. The gasket not only retains the powdered graphite in the lower unit 12, but it wipes the lead being sharpened to eliminate this extra step heretofore necessitated when sharpening leads by the use of conventional sharpeners.

The upper unit or guide 14 has a central tapered tang or axle 48 which is of a size to fit in the passage 36 of the lower unit 12. The axle 48 has a groove 50 near the lower end thereof below which is a lip 52 having notches 54 therearound. When the upper unit 14 is assembled with the lower unit 12, the axle 48 is pushed into the passage 36 until the lip 52 moves past the annular ridge 38 and snaps outwardly below the ridge. An upper annular flared portion 56 on the axle 48 cooperates with an annular flared portion 58 of the passage 36 to aid in positioning the upper unit 14 with respect to the lower unit 12.

The upper unit 14 further has a downwardly-extending annular flange 60 which lightly engages the upper surface of the gasket 40 to retain it on the projections 42 but does not place any undue pressure on the gasket. The upper unit 14 also has a truncated conical wall 62 extending upwardly from the flange 60 with an annular wall 64 integral with the upper edge of the wall 62 and with a truncated conical outer wall 66 extending downwardly from the annular wall 64. The wall 66 has an outwardly-extending lip 68 extending most of the way around the upper unit and serving to retain the outer edge of the gasket 40 in position with respect to the outer wall portion 26 of the lower unit 12. An annular ridge 70 can extend downwardly from the lip 60 to provide line engagement with the gasket 40.

At one peripheral portion of the upper wall 14, a tapered pencil guide passage 72 is formed to receive the end of a pencil, the lead of which is to be sharpened. The passage 72 terminates in a lower lead passage 74 which is positioned above the abrasive member 30 of the lower unit. When a lead 76 is inserted through the pasage 74, it deforms the outer edge portion of the gasket 40, pushing it downwardly so that the lower end of the lead 76 can engage the abrasive surface. As the upper unit 14 is rotated relative to the lower unit, the edge portion of the gasket continues to be deformed by the lead and then moves back to its horizontal position as soon as the lead passes. Again, by providing the thin upper wall portion 26, this portion and the abrasive member can yield somewhat particularly if a thick blunt lead is inserted through the passage 74. This prevents breakage of the lead and the yieldability also provides a more uniform contact and pressure of the abrasive surface relative to the lead.

For stiffness, a plurality of radially-extending ribs 78 can be located between the truncated conical walls 62 and 66 of the upper unit 14. Likewise, in the lower unit 12, ribs 80 can be located between the lower portion 20 of the outer wall 22 and the truncated conical wall 24, with ribs 82 located between the walls 24 and 34.

In order to maintain the sharpening device 10 in position on a surface where it is to be used, a two-sided adhesive disc or sheet 84 can be affixed to the lower surface of the lower unit 12 and specifically to the annular bottom wall 18. An annular lip 86 can be formed adjacent the bottom wall 18 and extend downwardly to provide a very shallow recess to receive the two-sided adhesive disc 84. The upper adhesive surface of the disc 84 not only adheres the disc to the annular bottom wall 18, but also to the end of the central wall 34 forming the passage 36 for additional support. The lower adhesive surface of the disc has a release paper 88 thereon which is removed when the sharpener is to be affixed to a surface in sharpening position.

Rather than employing the adhesive disc, a mounting block 90 of FIG. 1 can be used. This block can be affixed on a surface by a two-sided adhesive sheet similar to the disc 84, but of appropriate shape. The block 90 has a central tapered passage 92 with inwardly-extending ribs 94 with the block preferably being made of rubber or similar resilient material. When the lower outer portion 20 of the outer wall 22 of the lower unit 12 is pushed into the passage 90, it is twisted slightly to cause the ribs 94 to be deformed in a common direction and then exert pressure on the lower unit 12 to hold the sharpener 10 securely in place when in use. The block can be reused while the sharpening devices are disposed of.

Particularly in large drafting departments, the sharpeners 10 can be supplied in a long dispensing tube mounted on a wall or other suitable vertical surface. The sharpening devices can then be individually sequentially removed from a suitable opening at the bottom of the tube in a manner similar to that employed for dispensers of paper cups.

From the above, it will be evident that the sharpening device 10 can be relatively easily manufactured and sold at a low cost to provide for the expendability. The overall sharpener only employs four parts, the lower unit 12, the upper unit 14, the abrasive member or strip 30, and the gasket 40. The adhesive disc 84, when used, constitutes a fifth part.

Various modifications of the above-described embodiments of the invention will be apparent to those skilled in the art, and it is to be understood that such modifications can be made without departing from the scope of the invention, if they are within the spirit and the tenor of the accompanying claims.

I claim:

1. A device for sharpening points of leads or the like comprising a lower unit having an annular cavity opening upwardly and a central passage, means forming an abrasive surface adjacent said annular cavity, an upper unit having a central axle extending downwardly through said passage and having integral means at the lower end cooperating with integral means associated with said passage to enable said upper unit to rotate relative to said lower unit but to prevent said upper unit from being separated from said lower unit, said upper unit having means spaced from said axle and positioned over said abrasive surface means for receiving a lead.

2. A device according to claim 1 characterized by an annular flexible, resilient gasket having an inner edge supported on said lower unit between said passage and said annular cavity and extending outwardly to substantially close off said cavity.

3. A device according to claim 2 characterized by said lower unit having projection means between said passage and said cavity for engaging said gasket to prevent rotation of said gasket relative to said lower unit.

4. A device according to claim 3 characterized by said upper unit having a downwardly-extending flange contacting said gasket above said projection means.

5. A device according to claim 2 characterized by said upper unit having an outwardly-extending lip extending around most of said upper unit above an outer edge portion of said gasket.

6. A device according to claim 2 characterized by said gasket being made of a closed-cell foam material.

7. A device according to claim 6 characterized by said foam material having an upper plastic layer thereon.

8. A device according to claim 1 characterized by said integral means associated with said passage comprising an inwardly-extending ridge and said integral means of said axle comprises an outwardly-facing groove cooperating with said ridge.

9. A device according to claim 1 characterized by an adhesive disc having a downwardly-facing adhesive surface affixed to the bottom of said lower unit.

10. A device according to claim 1 characterized by a mounting block having an opening to receive a lower portion of said lower unit, and means for affixing said mounting block to a surface.

11. A device for sharpening lead comprising a lower unit having an outer wall of circular cross section, an inner wall of circular cross section, and a bottom wall connecting said outer and inner walls to form an upwardly-facing annular cavity, said inner wall having an inwardly-extending web at the upper end thereof, central wall means forming a passage centrally located with respect to said lower unit and having an upper end connected with said web, said device further comprising an upper unit having a central axle extending into said passage, said passage and said axle having structurally-integral cooperating means to resist said axle from being moved outwardly from said passage, and said upper unit further having wall means forming a guide with an opening at the bottom thereof spaced from said axle and positioned above a portion of said annular cavity, and abrasive means on said outer wall forming an abrasive surface below said opening of said guide.

12. A device according to claim 11 characterized further by said web having an annular gasket extending outwardly therefrom toward said outer wall to substantially close off said annular cavity, said gasket being free of said outer wall to enable a lead to be inserted between an outer edge portion of said gasket and said outer wall.

13. A device according to claim 11 characterized further by said cooperating means comprising a ridge on one of said passage means and said axle and a groove on the other of said passage means and said axle.

14. A device according to claim 11 characterized by the lower end of said central wall means forming the passage terminating substantially in the plane of said bottom wall.

15. A device according to claim 11 characterized by said outer wall adjacent said abrasive means being thinner than that portion of said outer wall below said abrasive means.

16. A device according to claim 11 characterized by said abrasive means comprising an abrasive strip affixed to an upper portion of said outer wall.

* * * * *